US005725405A

United States Patent [19]

Nakatani

[11] Patent Number: 5,725,405

[45] Date of Patent: Mar. 10, 1998

[54] METHOD AND APPARATUS FOR POSITIONING SPARK PLUG ELECTRODES

[75] Inventor: Hiroshi Nakatani, Kuwana, Japan

[73] Assignee: Nippondenso Co., Ltd., Kariya, Japan

[21] Appl. No.: 621,685

[22] Filed: Mar. 26, 1996

[30] Foreign Application Priority Data

Apr. 14, 1995 [JP] Japan ..... 7-113929

[51] Int. Cl.[6] ..... H01T 21/02

[52] U.S. Cl. ..... 445/4; 445/7; 445/64; 445/67

[58] Field of Search ..... 445/4, 7, 64, 67

[56] References Cited

FOREIGN PATENT DOCUMENTS 129472 12/1984 European Pat. Off. ..... 445/4

5-114455 5/1993 Japan .

5-129063 5/1993 Japan .

*Primary Examiner*—P. Austin Bradley

*Assistant Examiner*—Jeffrey T. Knapp

*Attorney, Agent, or Firm*—Cushman Darby & Cushman IP Group of Pillsbury Madison & Sutro LLP

[57] ABSTRACT

A center electrode of a spark plug has an oval shape in cross section as an identification mark. An electrode positioning apparatus fixedly holds a ground electrode and rotates an insulator together with a center electrode relative to the ground electrode. During the rotation, a signal light is irradiated toward the center electrode and the shape of the identification mark is detected from the received signal light. When the shape of the mark comes to correspond to a predetermined pattern, the center electrode is stopped from rotating and fitted solidly with the ground electrode.

12 Claims, 6 Drawing Sheets

METHOD AND APPARATUS FOR POSITIONING SPARK PLUG ELECTRODES

CROSS REFERENCE TO RELATED APPLICATION

This application is based upon and claims priority of Japanese Patent Application No. 7-113929 filed on Apr. 14, 1995, the content of which is incorporated herein by reference.

BACKGROUND OF THE INVENTION

1. Field of the Invention

The present invention relates to a method and apparatus for positioning electrodes of a spark plug used in an internal combustion engine.

2. Description of Related Art

A spark plug used in an internal combustion engine discharges and sparks high voltages supplied from a distributor in the space between a center electrode and a ground electrode to ignite air-fuel mixture. A discharge portion made of a noble metal chip with superior durability is disposed on the center electrode. Various contrivances have been made in the shape of the center electrode to obtain stable discharge between the electrodes.

At the time of assembling the spark plug, the positioning of the center electrode and the ground electrode must be accurately made and the discharge space between the electrodes must be precisely adjusted.

However, the positioning of the center electrode and the ground electrode as well as the adjustment of the space therebetween are manually done, which requires many manhours and tends to result in inaccurate electrode positioning.

SUMMARY OF THE INVENTION

In light of the above-described conventional problem, the present invention has an object to provide a method and apparatus for automatically positioning electrodes of a spark plug in which a center electrode and a ground electrode can be positioned rapidly and accurately.

According to the present invention, the center electrode of a spark plug is provided with an identification shape or identification mark for identifying its rotational position. With a discharge portion being disposed at a predetermined position on the center electrode, the position of the discharge portion can be identified by detecting the identification shape or the identification mark.

After fixing a housing of the spark plug at a predetermined position, an insulator holding the center electrode with the identification shape or the identification mark is rotated so that it provides the predetermined pattern which defines the desired final positional relation between the ground electrode (discharge end) fixed to the housing and the center electrode (discharge portion) fixed in the insulator.

BRIEF DESCRIPTION OF THE DRAWINGS

Additional features and advantages of the present invention will be more readily apparent from the following detailed description of preferred embodiments thereof when taken together with the accompanying drawings in which.

DETAILED DESCRIPTION OF PREFERRED EXEMPLARY EMBODIMENTS

A first preferred embodiment of the present invention is hereinafter described with reference to FIGS. 1 through 10.

Figure 1:
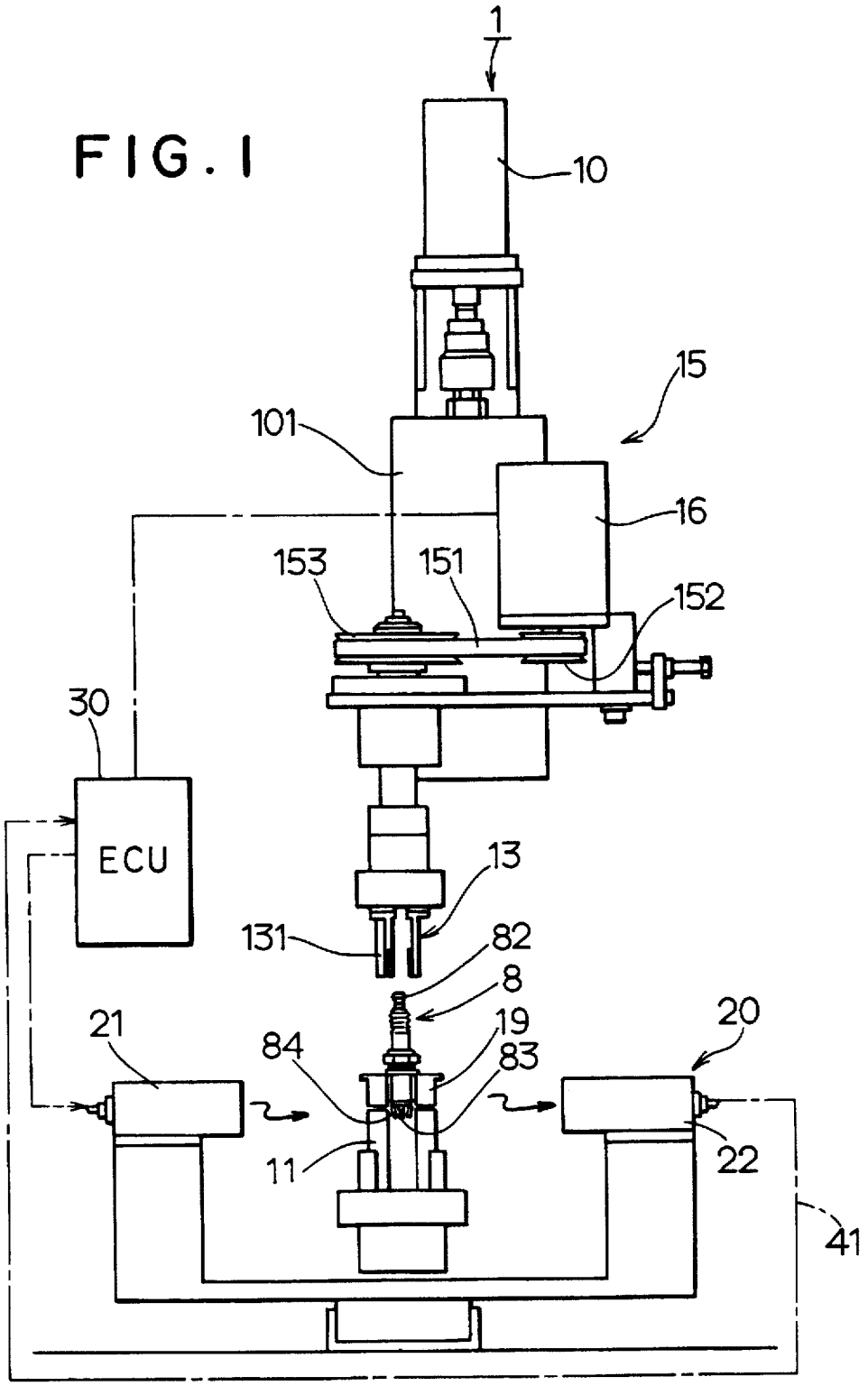
FIG. 1 is a schematic view of an electrode positioning apparatus according to a first embodiment of the invention.

As shown in FIG. 1, an automatic electrode positioning apparatus is designated by a reference numeral 1 and constructed to perform positioning operation of a center electrode 83 relative to a ground electrode 84 of a spark plug 8.

Figure 2:
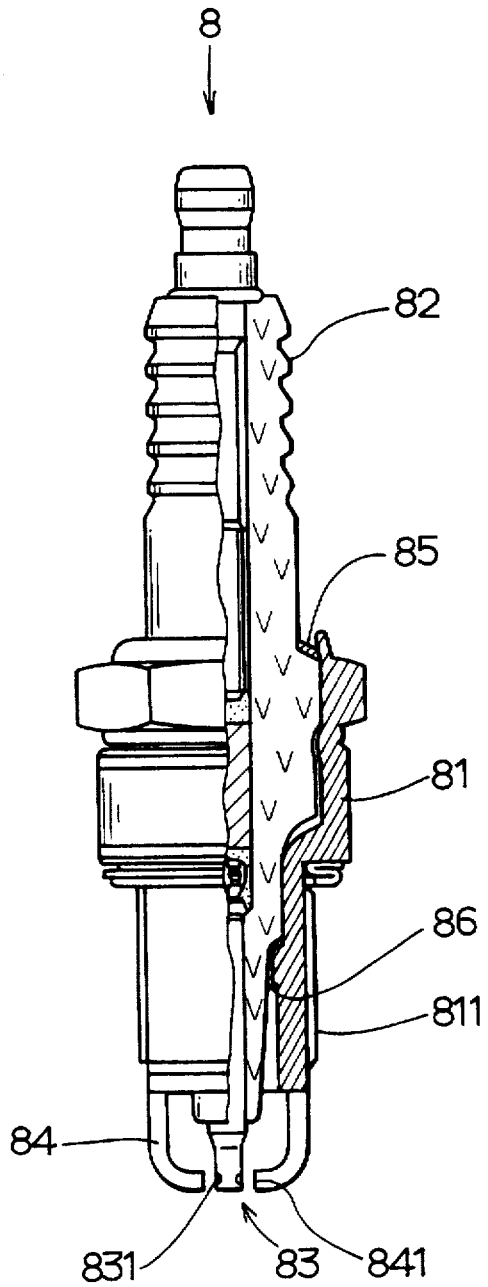
FIG. 2 is a partially sectional view of a spark plug used in the first embodiment.
Figure 3:
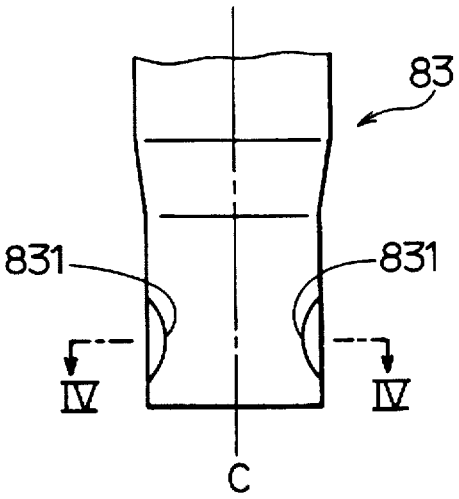
FIG. 3 is a partially expanded view of the edge of a center electrode of the spark plug shown in FIG. 2.
Figure 4:
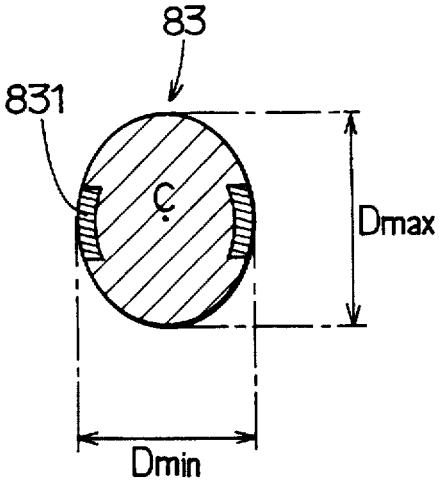
FIG. 4 is a sectional view of the center electrode taken along the line IV—IV in FIG. 3.
Figure 5:
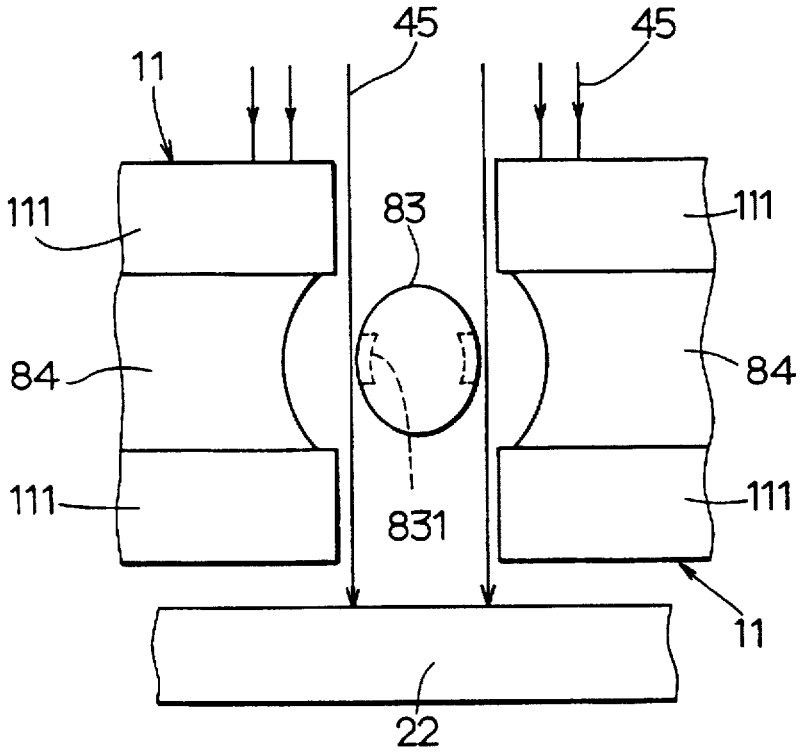
FIG. 5 is a bottom view showing an electrode chuck unit holding the ground electrode according to the embodiment shown in FIG. 1.

As shown in detail in FIGS. 2 through 4, the spark plug 8 comprises the center electrode 83 having a discharge portion 831 made of a noble metal and embedded on the circumferential surface at two locations, the ground electrode 84 having a discharge end 841 at two locations and located radially outside the discharge portion 831 to face radially the discharge portion 831, an insulator 82 axially holding the center electrode 83 tightly therein, and a housing 81 fixed to the ground electrode 84. A ring 85 and a packing 86 are interposed between the housing 81 and insulator 82. The housing 81 is formed with a thread 811 for thread engagement with a plug hole of the internal combustion engine (not shown).

The center electrode 83 which extends axially has an oval or elliptical cylindrical shape (as an identification mark) as best shown in FIG. 4 to enable identification of its rotational position when rotated around a central axis C. The center electrode 83 has the shape of an oval cylinder with an oval sectional shape and the above-described metal chips are disposed on the both sides (discharge portion 831) of the shorter diameter portion.

Referring back to FIG. 1, the electrode positioning apparatus 1 comprises an electrode chuck unit 11 as a fixing means for fixing the ground electrode 84 and the housing 81, an insulator chuck unit 13 as a holding means for holding the insulator 82, a lift 10 with a base 101, a driving unit 15 (stepper motor 16, belt 151, pulleys 152, 153) for rotating the insulator chuck unit 13, a detecting unit 20 (light source 21, optical sensor 22) for detecting the rotational position of the center electrode 83 relative to the ground electrode 84, and an electronic controller unit 30 for controlling the driving unit 15 by receiving an output signal 41 from the detecting unit 20.

In this apparatus, the spark plug 8 is mounted first on the electrode chuck unit 11. That is, the thread 811 of the housing 81 is held by a holder 19 and the ground electrode 84 is tightly held in position in the electrode chuck unit 11. In this instance, the housing 81 is only loosely fitted with the insulator 82 so that the center electrode 83 is kept rotatable against the ground electrode 83. As shown in detail in FIG. 5, the electrode chuck unit 11 has four claws 111 extending horizontally to hold tightly the radially extending portion of the ground electrode 84 therebetween, while enabling transmission of light 45 from the light source 21 to the optical sensor 22 therethrough.

Figure 6:
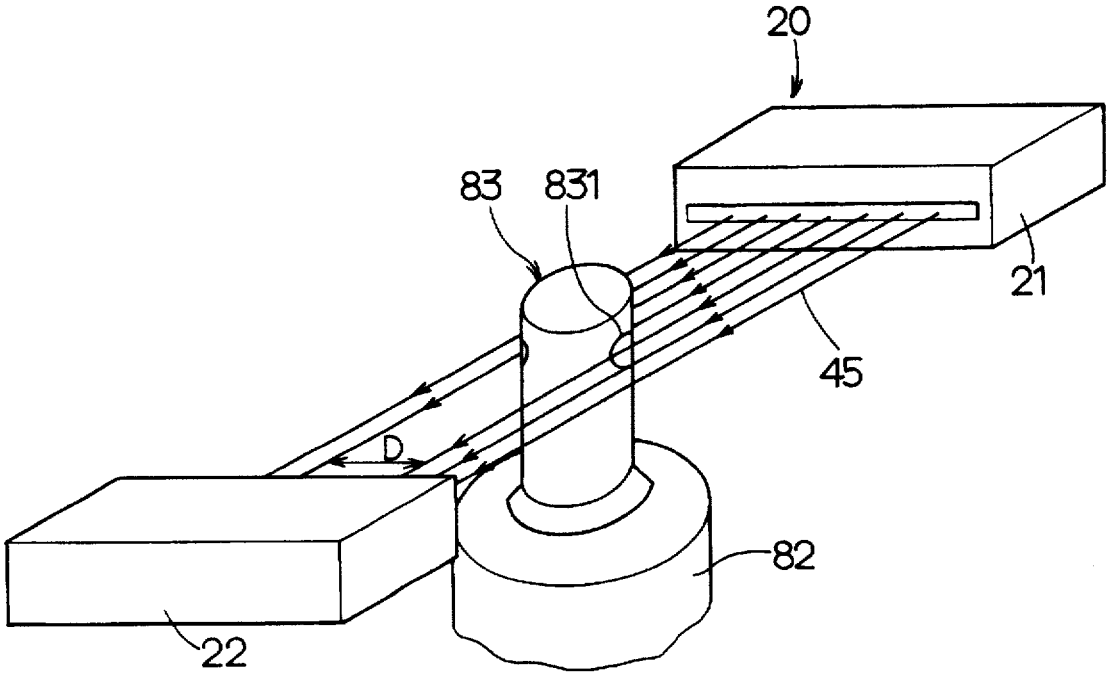
FIG. 6 is a perspective view showing the detecting unit used in the first embodiment shown in FIG. 1.

The detecting unit 20 has, as shown in FIG. 6, the light source 21 irradiating the light (signal laser light) 45 in the perpendicular direction with respect to the axial center of the center electrode 83 and the optical sensor 22 disposed at the opposite side of the light source 21 with the center electrode 83 therebetween. In the detecting unit 20, optical sensor 22 receives the light 45 which is irradiated from the light source 21 and is not shaded by the center electrode 83 and measures the diameter (shaded width) D of the center electrode 83 from the shaded amount of the signal light 45, providing an electric signal 41 indicative of the measured diameter D.

Figure 7:
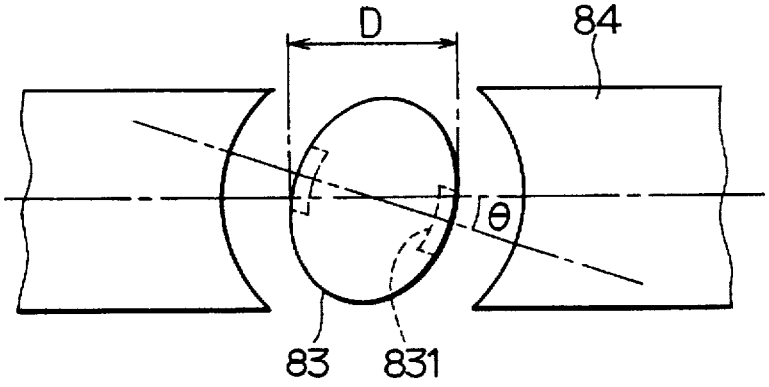
FIG. 7 is a bottom view showing positional relation of the center electrode to the ground electrode in the spark plug shown in FIG. 2.
Figure 8:
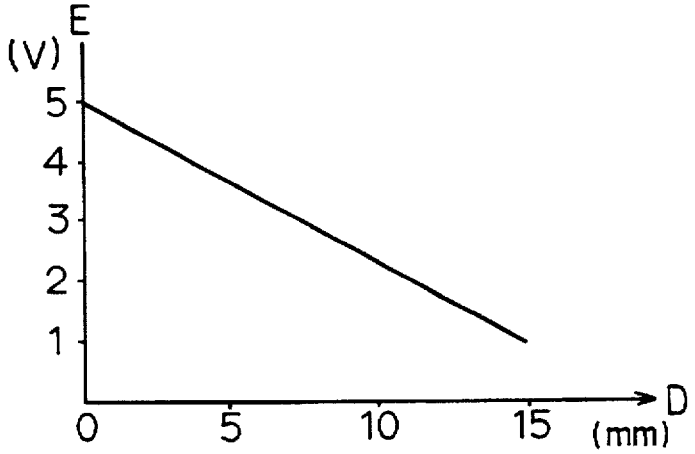
FIG. 8 is a graph representing the relation between the shaded width D and the output E of an optical sensor according to the first embodiment shown in FIGS. 1 and 6.

It is to be noted that, as shown in FIG. 7, the measured diameter D changes with the rotational position or angle θ of the center electrode 83 relative to the ground electrode 84. FIG. 8 shows the magnitude E of signal 41 produced by the optical sensor 22 in relation to the shaded width D assumed to vary from zero to the maximum value Dmax. In actuality, the shaded width D changes only between the minimum value Dmin to the maximum Dmax.

Figure 9:
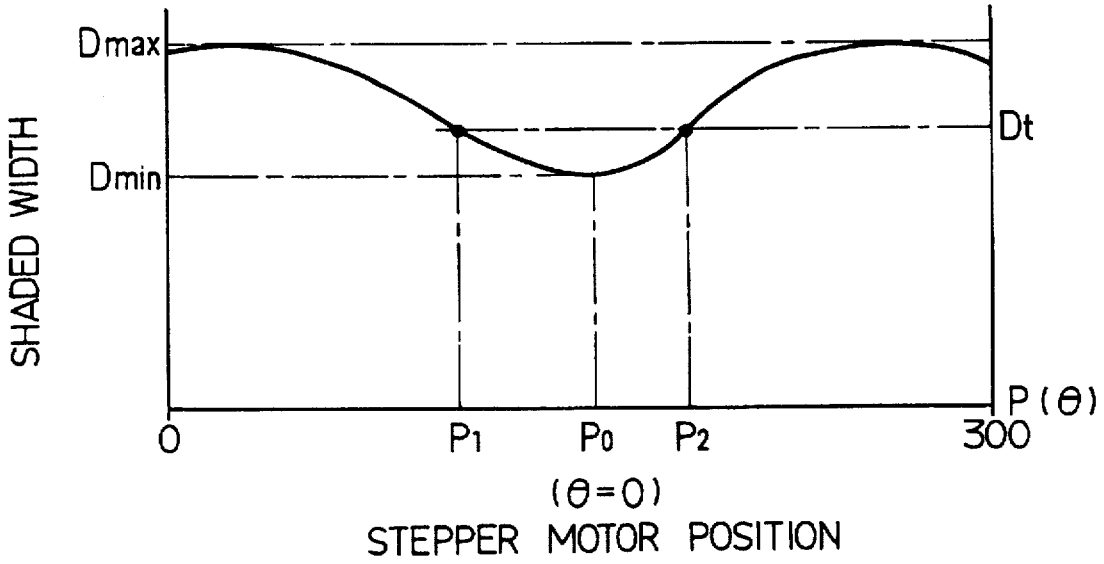
FIG. 9 is a graph representing the relation between the number of rotation steps P of a stepping motor and the shading width D caused by the center electrode according to the first embodiment shown in FIGS. 1 and 6.

The controller 30, receiving the signal 41, drives the stepper motor 16 by one step (0.72°) consecutively and stores the output (shaded width D) of the optical sensor 22 corresponding to the rotation angle θ shown in FIG. 7. The controller 30 controls in turn the driving unit 15 so that the output signal 41 of the detecting unit 20 becomes a predetermined value. As shown in FIG. 9, the rotational position or the number of rotation steps P of the stepper motor 16 corresponds to the shaded width D. The center electrode 83 is considered positioned as desired when the discharge portion (noble metal chip) 831 faces the center of the discharge end of the ground electrode 84, i.e., when the shaded width D becomes the minimum value Dmin (θ=0).

The driving unit 15 is mounted on the base 101 which is moved up and down by the lift 10 with the insulator chuck unit 13. The insulator chuck unit 13 holds tightly the insulator 82 with three claws 131 after the base 101 descends to a predetermined position. The stepper motor 16 turns the insulator chuck unit 13 via the belt 151 and pulleys 152, 153 thereby to turn the center electrode 83 relative to the ground electrode 84. The stepper motor 16 is a high-speed control motor to change a rotational angle in the unit of 0.72°.

The control process performed by the controller 30 in the electrode positioning apparatus 1 is hereinafter explained with reference to the flow chart shown in FIG. 10.

First, the spark plug 8 is held by the holder 19 in a step 601 under the condition that the housing 81 fixed to the ground electrode 84 is loosely fitted with the insulator 82 housing the center electrode 83 therethrough. Next, the ground electrode 84 is held by the electrode chuck unit 11 in a step 602. The lift 10 makes the base 101 descend in a step 603. The insulator 82 is held by the insulator chuck unit 13 in a step 604.

The shaded width D of the center electrode 83 in this condition is measured based on the output signal 41 of the detecting unit 20 in a step 605 and the output value is stored in a step 606. In the next step 607, the number of rotation steps P of the stepper motor 16 is changed by one step (incremented as P=P+1), and the motor 16 rotates by one step in a step 608. The number of rotation steps P is checked in a step 609. Until the value P reaches 300 (216°), i.e., until the center electrode 83 rotates more than one half of a complete rotation (360°), the routine of the steps 605 to 608 is repeated to accumulate the data shown in FIG. 9.

When the value P reaches 300, i.e., the data shown in FIG. 9 have been accumulated, the step proceeds from the step 609 to 610, 611 to calculate the number of rotation steps $P_1$ and $P_2$ where the shaded width D becomes a predetermined value Dt (a threshold value set slightly larger than the minimum value Dmin).

The mean value $P_0$ of $P_1$ and $P_2$ is calculated in a step 612 in order to determine the most desirable rotational position of the center electrode 83, i.e., θ=0. This means that the discharge portion 831 of the center electrode 83 radially faces the discharge end of the ground electrode 84 of the center electrode 83. In the following step 613, the center electrode 83 is checked as to whether its dimensions Dmax, Dmin and Dmax−Dmin are in a standard value or not. In other words, whether the shortest dimension Dmin and the longest dimension Dmax of the center electrode 83, and the difference between the diameters (Dmax−Dmin) are allowable values or not is checked. If the result is "No", the process proceeds to a step 616 to generate a signal indicating an error.

On the other hand, if the result in the step 613 is "Yes", the process proceeds to a step 614 to drive the stepper motor 16 until the rotational position P reaches the above-described value $P_0$ (θ=0 ). At this position, the motor 16 stops its rotation. In a step 617, the insulator chuck unit 13 opens and, in a step 618, the base 101 is moved to ascend. Next, the electrode chuck unit 11 opens in a step 619 and the housing 81 is firmly fixed onto the housing 81 by caulking or the like, thus fixing the positions of the electrodes 83 and 84.

According to the electrode positioning apparatus 1 as described above, the high-speed stepper motor 16, the optical detecting unit 20 and the controller 30 can position the center electrode 83 and the ground electrode 84 in right position automatically with high accuracy.

Figure 11:
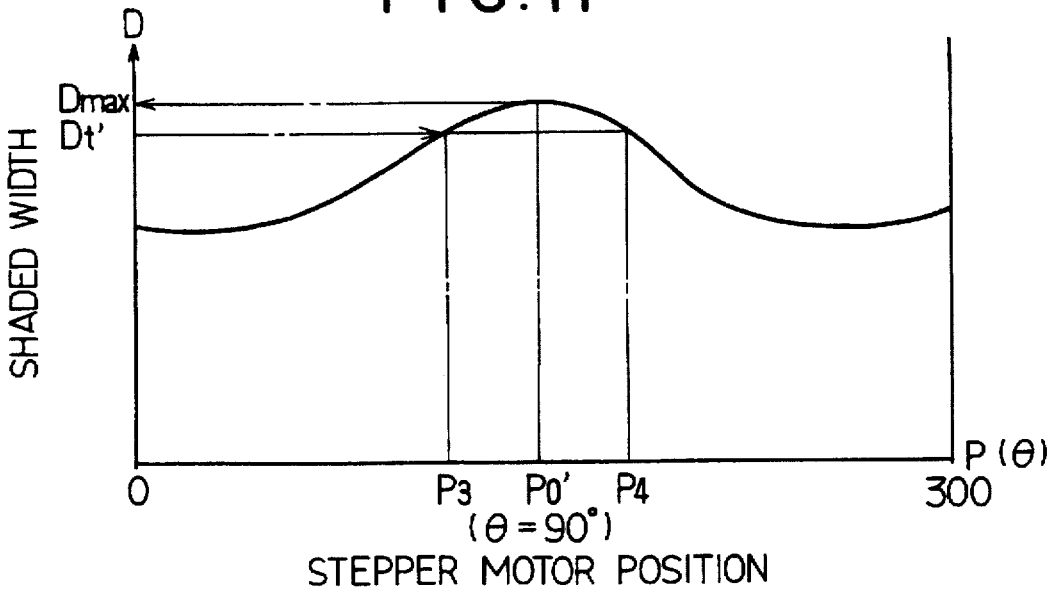
FIG. 11 is a graph representing the relation between the number of rotation steps P of a stepping motor and a shaded width D caused by the center electrode according to a second embodiment of the present invention.
Figure 12:
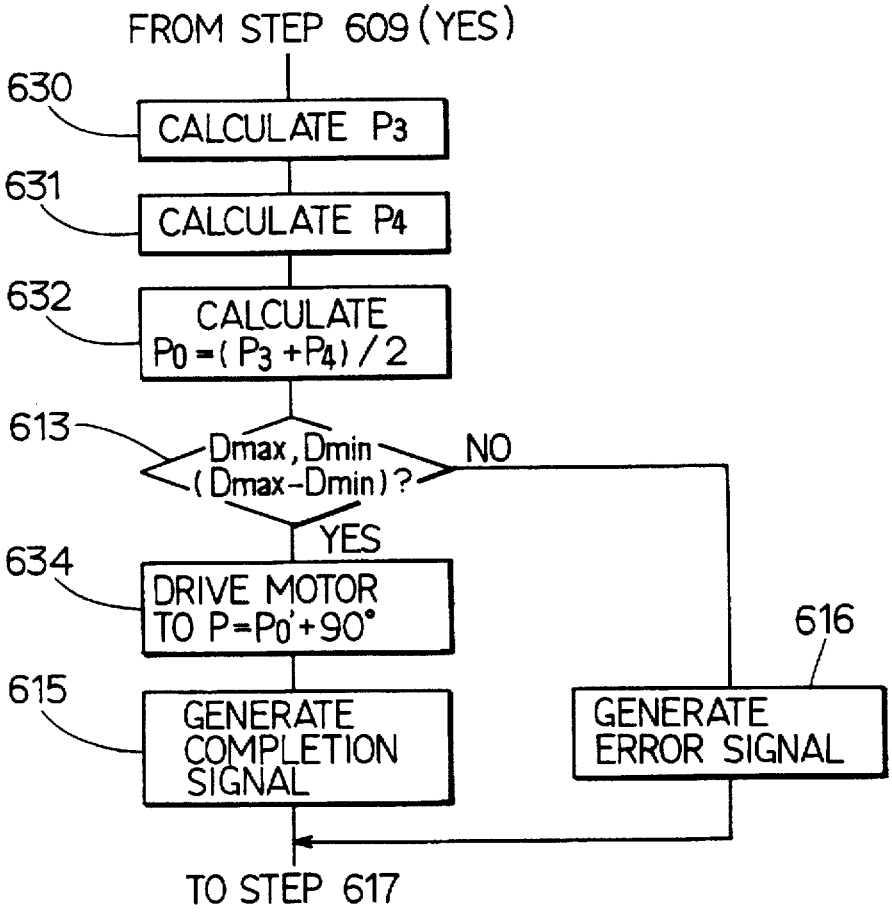
FIG. 12 is a partial control flow chart of the electrode positioning apparatus according to the second embodiment.

A second embodiment of the present invention is described briefly with reference to FIGS. 11 and 12, using the same reference numerals for the same component parts and steps as the first embodiment.

In this embodiment, a rotation step $P_0'$ (θ=90°) of the motor 16 which provides the maximum value Dmax of the shaded width D of the center electrode 83 is calculated and, based on it, the center electrode 83 is subsequently fixed at the predetermined position (θ=0°).

Figure 10:
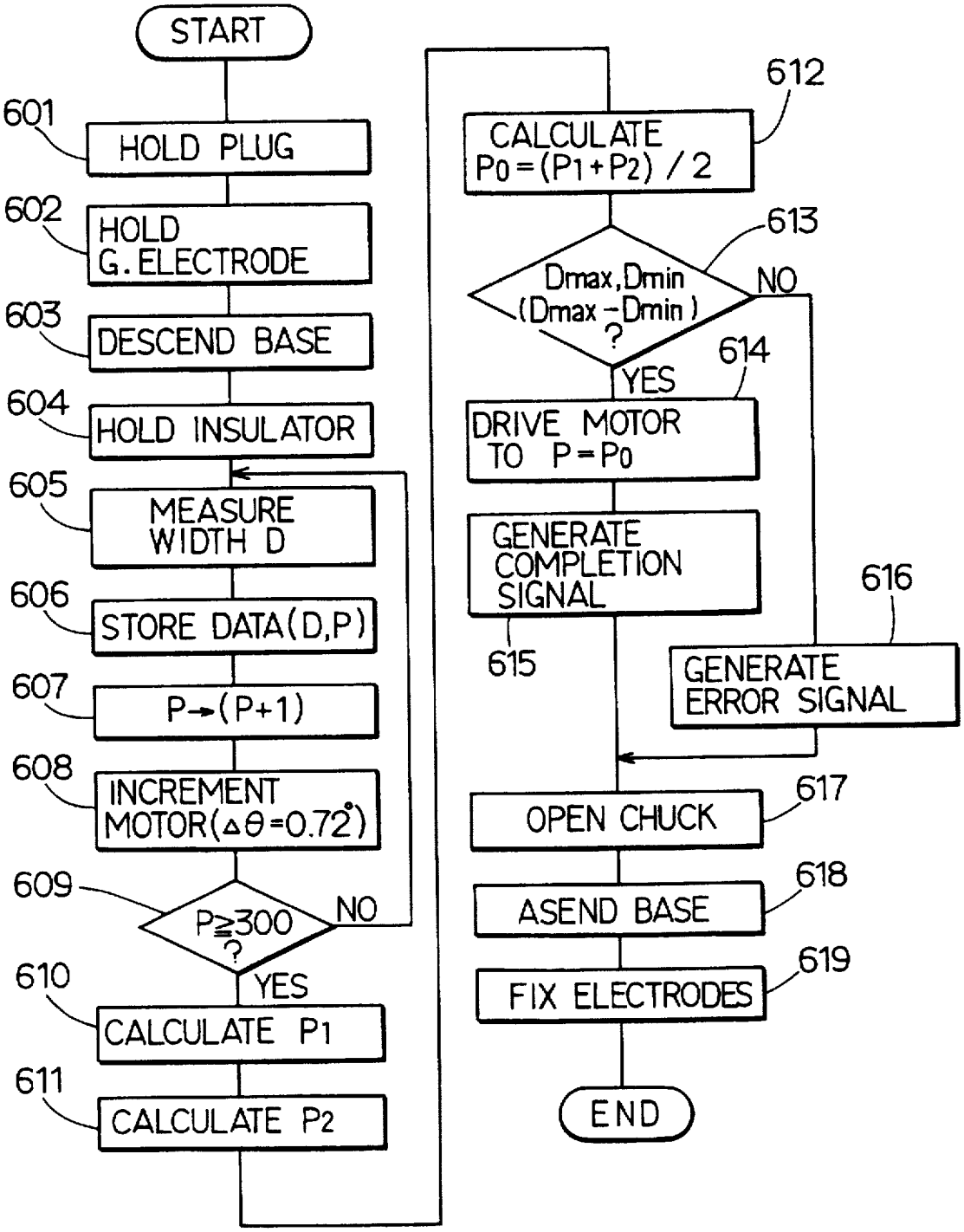
FIG. 10 is a control flow chart of the electrode positioning apparatus according to the first embodiment shown in FIG. 1.

For this control, as shown in FIG. 12, steps 630 through 634 are performed in place of the steps 610 through 614 in FIG. 10. In other words, the values of $P_3$ and $P_4$ shown in FIG. 11 are calculated based on the threshold value Dt' slightly smaller than the maximum value Dmax in the steps 630 and 631, and the number of rotation steps $P_0'$ corresponding to the shaded width Dmax is obtained in the step 632. In the step 634, the motor 16 is driven to rotate to and stopped at the position P=P'+90° so that the center electrode 83 is fixed at this position. Thus, the rotation angle of the motor 16 shifts to the 90°-turned position from the position of the above-described position $P_0'$.

The present invention should not be limited to the above-described embodiments but may be modified in many other ways without departing from the spirit of the invention.

What is claimed is:

1. A method for positioning electrodes of a spark plug, which has a center electrode, an insulator holding said center electrode therethrough, a ground electrode located outside said center electrode, and a housing fixed to said ground electrode, said method comprising the steps of:

providing said center electrode with an identification mark;

fixing said housing and said ground electrode in position on a base;

turning said insulator and said center electrode around a central axis thereof with said insulator loosely fitted in said housing;

detecting a shape of said identification mark of said center electrode while said insulator is turning;

stopping said turning step at a position where the detected shape of said identification mark becomes a predetermined pattern; and fixing solidly said housing to said insulator to keep a positional relation of said center electrode and said ground electrode existing at the time of said stopping step.

2. An apparatus for positioning a center electrode and a ground electrode of a spark plug, in which said center electrode has an identification mark and a discharge portion made of a noble metal and said ground electrode has a discharge end located outside and radially facing said discharge portion, said apparatus comprising:

fixing means for fixing said ground electrode in position;

holding means for holding said center electrode movably relative to said ground electrode;

driving means for rotating said holding means together with said center electrode;

detecting means for detecting a shape of said identification mark of said center electrode during rotation of said center electrode; and a controller for controlling said driving means in accordance with an output signal of said detecting means indicative of the detected shape of said identification mark, said controller stopping said driving means when the detected shape of said identification mark becomes a predetermined pattern.

3. An apparatus according to claim 2, wherein said detecting means includes:

a light source irradiating signal light radially toward said center electrode; and an optical sensor sensing said signal light passing through said center electrode.

4. An apparatus according to claim 3, wherein said center electrode has an oval cross section as said identification mark.

5. An apparatus according to claim 4, wherein said center electrode is rotated more than one half of complete rotation thereof.

6. A method for positioning a noble metal member provided on a center electrode toward an end of a ground electrode in a spark plug, said method comprising the steps of:

fixing one of said center electrode and said ground electrode on a fixed base;

irradiating a signal light from a radial side of said center electrode;

turning the other of said center electrode and said ground electrode relative to said one of said center electrode and said ground electrode; and detecting an amount of said light passing by said center electrode and thereby determining a relative position of said noble metal member of said center electrode to said ground electrode based on a detected value of said light amount.

7. A method according to claim 6, wherein said center electrode has an oval shape in cross section having a longest diameter and a shortest diameter.

8. A method according to claim 7, wherein said noble metal member is provided at a position of the shortest diameter.

9. A method according to claim 8, further comprising the step of:

stopping said turning step at a position 90 degrees turned from a position where the detected amount of said signal light becomes a maximum.

10. A method according to claim 8, further comprising the step of:

stopping said turning step at a position where the detected amount of said signal light becomes a minimum.

11. A method according to claim 6, further comprising the steps of:

keeping, during said turning step, said center electrode and said ground electrode in a loosely fitted condition; and fitting, after said detecting step, said center electrode and said ground electrode solidly to each other.

12. A method according to claim 7, wherein said turning step performs a first rotation of more than 180° to cover at least one of the shortest diameter and the longest diameter therein, and then a second rotation up to a position determined based on said detected value of said detecting means is indicative of said at least one of said shortest diameter and said longest diameter.

* * * * *